US010267557B2

(12) United States Patent
Taboada

(10) Patent No.: US 10,267,557 B2
(45) Date of Patent: Apr. 23, 2019

(54) COOLER COLD TAP ADAPTER

(71) Applicant: Keith Taboada, Brielle, NJ (US)

(72) Inventor: Keith Taboada, Brielle, NJ (US)

( * ) Notice: Subject to any disclaimer, the term of this patent is extended or adjusted under 35 U.S.C. 154(b) by 0 days.

(21) Appl. No.: 15/487,400

(22) Filed: Apr. 13, 2017

(65) Prior Publication Data

US 2018/0299191 A1 Oct. 18, 2018

(51) Int. Cl.
*F25D 23/06* (2006.01)
*F25D 31/00* (2006.01)

(52) U.S. Cl.
CPC ..... *F25D 31/003* (2013.01); *F25D 2331/804* (2013.01); *F25D 2331/806* (2013.01); *F25D 2400/12* (2013.01)

(58) Field of Classification Search
CPC ... F25D 3/06; F25D 3/08; F25D 3/003; F25D 2231/086
USPC ..... 62/398, 396
See application file for complete search history.

(56) References Cited

U.S. PATENT DOCUMENTS 5,052,184 A * 10/1991 Jarvis ..... A45C 11/20 62/60
5,222,631 A * 6/1993 Hood ..... B67D 1/0835 222/131
2011/0011569 A1* 1/2011 Baker ..... F28D 7/0016 165/165
2012/0042682 A1* 2/2012 Cominski ..... B67D 1/0009 62/389

* cited by examiner

*Primary Examiner* — Keith M Raymond
*Assistant Examiner* — Nael N Babaa
(74) *Attorney, Agent, or Firm* — Keith Taboada

(57) ABSTRACT

Described herein are an adapter kit for non-destructively adapting a cooler having a melt water drain hole into a cold tap, a cooler configured as a cold tap, and a method for non-destructively adapting a cooler having a melt water drain hole into a cold tap. In one example, the adapter kit allows the cooler to be configured as a cold tap, while being readily removable to allow the cooler to return to it's undamaged, original form.

19 Claims, 8 Drawing Sheets

212
214
216
208
210
250
252
254
260
262
266

106
104
200
202
110
220
278
272
270
264
130
206
108

COOLER COLD TAP ADAPTER

BACKGROUND

Field

Embodiments of the invention generally relate to cold taps for chilling beverages, such as beer and the like, and more specifically, an adapter kit for non-destructively adapting a cooler into a cold tap, also known as a jockey box.

Background

There is no question that cold beer is the next best thing to free beer. Cold taps are available to chill beer. Kits are also available to turn a commercially available cooler into a cold tap. However, such kits require drilling holes in the sidewall or lid of cooler to enable mounting of valves (i.e., taps) to the cooler, which may render the cooler unsuitable for its original purpose. Thus, the cooler cannot be returned to its original form, particularly do to the holes drilled through the cooler.

SUMMARY

An adapter kit for non-destructively adapting a cooler into a cold tap is provided. The adapter allows the cooler to be configured as a cold tap, while being readily removable to allow the cooler to return to its undamaged, original form.

Described herein are an adapter kit for non-destructively adapting a cooler having a melt water drain hole into a cold tap, a cooler configured as a cold tap, and a method for non-destructively adapting a cooler having a melt water drain hole into a cold tap. In one example, an adapter kit for non-destructively adapting a cooler having a melt water drain hole into a cold tap includes metal cooling element and a multi-passage (MP) fitting. The metal cooling element is adapted for cooling liquid within the cooler. The cooling element has a cooling element inlet port and a cooling element outlet port. The MP fitting includes a body having a first end adapted to be exposed to an interior volume of the cooler and a second end adapted to be exposed to an outside of the cooler. The body is sized to removably extend at least partially into the melt water drain hole formed through the cooler. A first passage is formed through the body between a first outlet port disposed on the first end and a first inlet port disposed on the second end. A second passage is formed through the body between a second outlet port disposed on the first end and a second inlet port disposed on the second end. The first outlet port is couplable to the cooling element inlet port and the second outlet port is couplable to the cooling element outlet port.

In a second example, a cooler is provided. The cooler includes a base having a melt water drain hole formed therethrough, a metal cooling element disposed in an interior volume of the base, and a multi-passage (MP) fitting. The cooling element has a non-linear flow path formed therein. The non-linear flow path terminates at a cooling element inlet port and a cooling element outlet port. The MP fitting includes body having a first end exposed to the interior volume of the base and a second end exposed an exterior of the base. The body is removably disposed at least partially into the melt water drain hole formed through the body. A first passage is formed through the body between a first outlet port disposed on the first end and a first inlet port disposed on the second end. The first outlet port is fluidly coupled to the cooling element inlet port. A second passage is formed through the body between a second outlet port disposed on the first end and a second inlet port disposed on the second end. The second outlet port is fluidly coupled to the cooling element outlet port.

In another example, a method for non-destructively adapting a cooler having a melt water drain hole into a cold tap is provided. The method includes inserting a body of a multi-passage (MP) fitting into the melt water drain hole of the cooler, coupling the MP fitting to a cooling element disposed in the cooler, and coupling the MP fitting to a beverage source.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures. It is contemplated that elements and features of one embodiment may be beneficially incorporated in other embodiments without further recitation.

Figure 1:
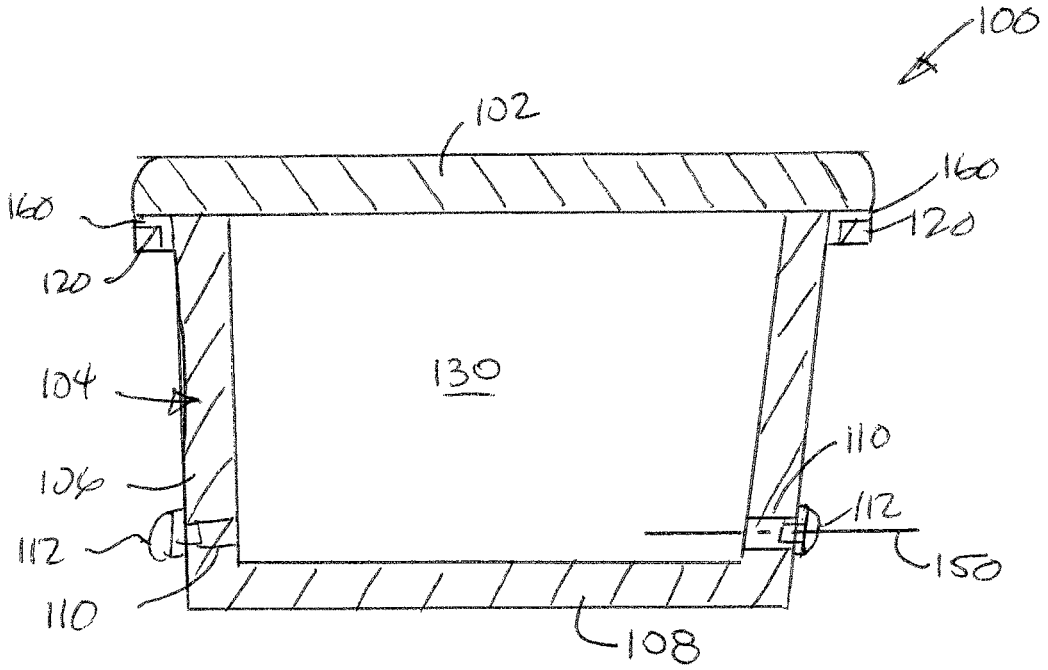
FIG. 1 a schematic sectional view of a conventional cooler.

It is to be noted, however, that the appended drawings illustrate only exemplary embodiments of this invention and are therefore not to be considered limiting of its scope, for the invention may admit to other equally effective embodiments.

DETAILED DESCRIPTION

Embodiments of the present invention described herein include an adapter kit (referred below as a cold tap adapter) which may be utilized to non-destructively convert a conventional ice chest (i.e.,) cooler, such as available from Igloo, Coleman, Engle, Yeti, RTIC, Frigid Rigid, and the like, into a cold tap, also known as a jockey box, without altering the physical construction of the cooler. In other words, the adapter kit may be removed from the cooler after use, returning the cooler to its original form as purchased from the manufacturer without any "after purchase" physical modifications to the cooler that are purpose specific for use with the adapter kit.

Advantageously, once the adapter kit is removed from the cooler, the cooler does not include any penetrations other than those that would have been present in the cooler as originally purchased from the cooler manufacturer. This enables the cooler to can be used both as a jockey box, and additionally return to its original form for use as a conventional ice chest.

The adapter kit includes two main components; a cooling element and a multi-passage (MP) fitting. The cooling element is utilized to circulate a beverage provided from a keg (or other source) within the cooler. In some embodiments, the cooling element may be a cold plate. In other embodiments, the cooling element may be one or more coils of metallic tubing. Ice, provided in the cooler, chills the beverage flowing through the cooling element.

The MP fitting includes at least two passages to enable simultaneous flows of the beverage both into and out of the cooler. The MP fitting is sized to fit through a conventional drain hole that already is formed in a side wall of the cooler. Stated differently, the conventional cooler includes a drain hole as conventionally available from the cooler manufacturer, and the MP fitting is adapted to interface with the drain hole to allow connection to the cooling element. For example, one end of the MP fitting is exposed to the inside the cooler through the drain hole and is configured to couple to the inlet and outlet of the cooling element. The opposite end of the MP fitting is exposed to outside the cooler and is configured to couple to a tap and keg (or other beverage source). The MP fitting may extend at least partially into the drain hole or otherwise be interfaced with the drain hole in a manner that prevents water, from melting ice, from leaking from the interior of the cooler.

In one embodiment, a flow of beverage enters a first passage of the MP fitting disposed in the drain hole of the cooler. The flow of beverage exits the first passage of the MP fitting and enters an inlet port of the cooling element either directly or via a short length of tubing coupling the cooling element and the MP fitting. The beverage then circulates through the cooling element where it is chilled, finally exiting the cooling element through an outlet port connected to a second passage of the MP fitting. The outlet port of the cooling element may be coupled either directly or via a short length of tubing to the MP fitting. The beverage then exits the second passage of the MP fitting to a tube coupled to the MP fitting. The tube couples the MP fitting to a tap from which the now chilled beverage may be dispensed for consumption.

FIG. 1 is an exemplary sectional view of a conventional cooler 100 in which an adapter kit, hereinafter referred to as cold tap adapter 200, as described above that may be utilized as further discussed with reference to FIGS. 2-3 below. The cooler 100 includes a base 104 having one or more sidewalls 106 and a bottom 108 that define an interior volume 130. The top of the sidewalls 106 terminates in a flange 120 upon which a lid 102 is seated to enclose the volume 130. The flange 120 may include an aperture 160 that is designed to accept a strap (not shown) for securing the cooler 100 to the surface upon which the cooler 100 is supported. In one example, the aperture 160 has an "L" shape that includes a vertical opening through the flange 120 that connects with a horizontal groove formed in the top of the flange 120. The lid 102 is removable, often through use of a hinge, to allow the volume 130 to be accessed to place ice or other items in the cooler 100.

The cooler 100 generally includes at least one melt water drain hole 110 formed through the sidewall 106 proximate the bottom 108 of the base 104. The drain hole 110 is sealed by a plug or cap 112, which may be removed to allow water, typically from melted ice, to be drained from the interior volume 130 without having to tip the cooler 100 over. The drain hole 110 may be threaded to engage a mating thread of the cap 112. Alternatively, the cap 112 may be configured to sealingly press-fit into the drain hole 110. Alternatively, the cap 112 may be configured to sealingly press-fit over a lip extending from the drain hole 110. In the example depicted in FIG. 1, the cooler 100 has a first drain hole 110 in one sidewall 106 and a second drain hole 110 (shown in phantom) in the opposite sidewall 106.

Generally, cooler 100 may be cylindrical with a single sidewall 106 or rectangular with four sidewalls 106. In rectangular embodiments, the sidewall with the drain hole 110 is typically formed through a shorter sidewall 106, the shorter sidewall 106 being adjacent the long sidewalls 106, with one of the long sidewalls 106 having the hinge for the lid 102 defining the back of the cooler and the other long sidewall 106 opposite the hinge defining the front of the cooler 100. As further discussed below, a centerline 150 of the drain hole 110 is generally parallel to the long sidewalls 106 and perpendicular to the short sidewalls 106.

Figures 2, 2A:
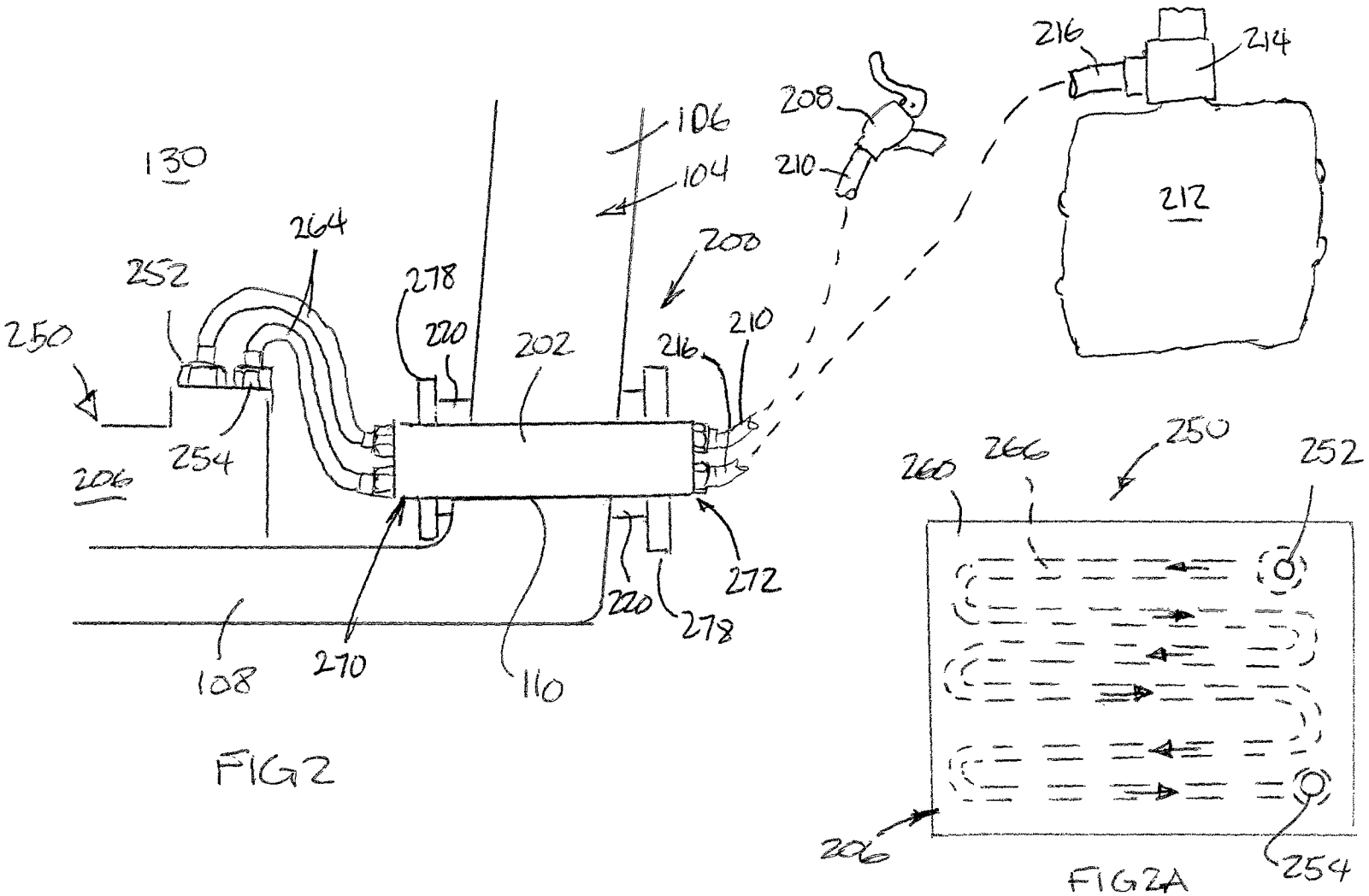
FIG. 2 is a partial sectional view of a conventional cooler equipped with a cold tap adapter.
FIG. 2A is a top view of one embodiment of a cold plate.

FIG. 2 is a partial sectional view of a conventional cooler, such as the cooler 100 described above, equipped with a cold tap adapter 200. As discussed above, the cold tap adapter 200 may be non-destructively fitted to the cooler 100, such that when the cold tap adapter 200 is removed, the cooler 100 remains in an "as originally purchased from the manufacturer" form.

The cold tap adapter 200 includes a cooling element 250 and a multi-passage (MP) fitting 202. The cooling element 250 of the cold tap adapter 200 is configured to fit within the interior volume 130 of the cooler 100, while the MP fitting 202 is configured to fit through the drain hole 110, or "factory original" hole configured to allow conventional use of the cooler 100 as an ice chest without the cold tap adapter 200 being installed. While the partial view of the cooler 100 illustrated only one drain hole 110 equipped with the cold tap adapter 200, as second cold tap adapter 200 may be optionally utilized in a second drain holes 110 should the cooler 100 equipped with multiple drain holes 110. This allows beverages from more than one keg to be chilled simultaneously within the cooler 100.

The cooling element 250 is utilized to circulate a beverage provided from a keg (or other source) within the cooler 100. The cooling element 250 generally has an inlet 252 and an outlet 254 coupled by a non-linear flow path 266. The non-linear flow path 266 is contained within the cooling element 250 such that beverages flowing though the cooling element 250 between the inlet 252 and outlet 254 do not leak into the interior volume 130 of the cooler 100. The cooling element 250 is fabricated from a thermally conductive material suitable for contact with beverages, such as aluminum and stainless steel.

In some embodiments, the cooling element 250 may be a cold plate 206. For example as illustrated in FIG. 2A, the cold plate 206 generally has a metal body 260 in which the non-linear flow path 266 is routed in a manner that provides a long residence time of the beverage within the cold plate 206, thus enhancing the chilling of the beverage flowing through the cold plate 206. For example, the non-linear flow path 266 may be a serpentine geometry. Cold plates 206 that may be adapted to benefit from the invention are available from MICRO MATIC USA, Inc., of Brooksville, Fla., among other sources.

Figure 3:
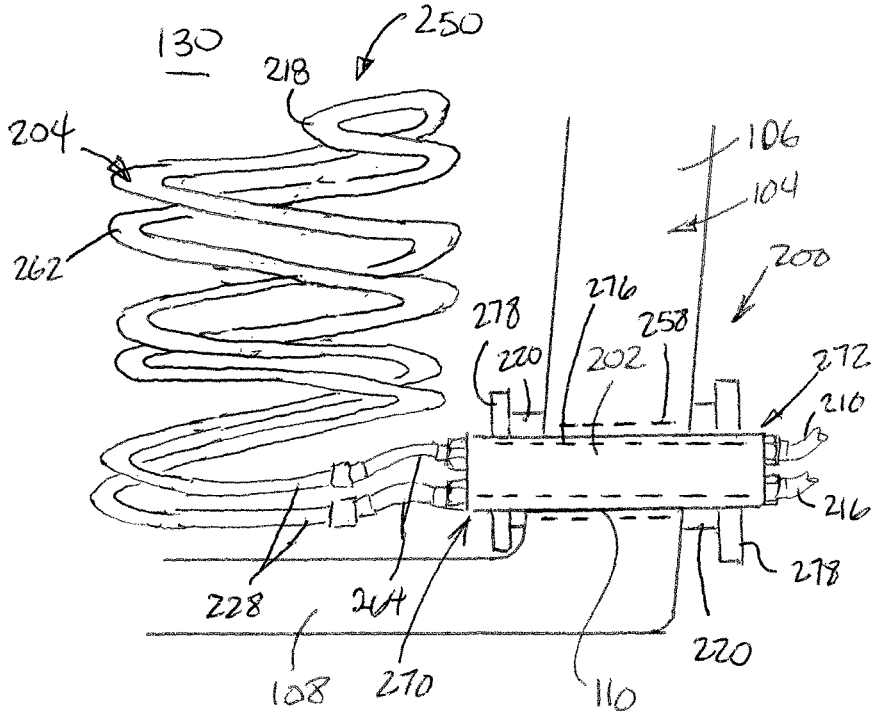
FIG. 3 is a partial sectional view of a conventional cooler equipped with another embodiment of a cold tap adapter.
Figure 3A:
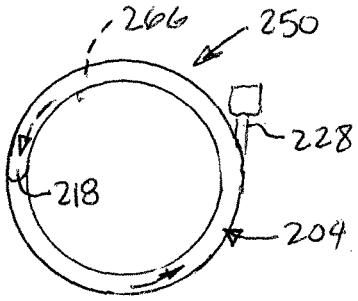
FIG. 3A is a top view of one embodiment of a cooling coil.

FIG. 3 is a partial sectional view of a conventional cooler, such as the cooler 100 described above, equipped with another cold tap adapter 200 similar to that shown and discussed above, except wherein the cooling element 250 is in the form of one or more cooling coils 204. One cooling coil 204 is shown in FIG. 3, although multiple cooling coils 204 may be utilized. The cooling coil 204 has a metal tubular body 262. The tubular body 262 has opposing ends 228 and a reversing bend 218 located at approximately the midpoint of the coil 204. The body 262 is wound in a coil in an upward direction from one end 228 to the reversing bend 218, and then wound in a coil in a downward direction to the opposite end 228. The coil shape of the winding body 262 may be generally cylindrical, or have another shape, such as the general shape of the cooler base 104, such as a rectangular shape. The coil shape of the winding body 262 defines the non-linear flow path 266 (as illustrated in FIG. 3A) that provides a long residence time of the beverage within the cooling coil 204, thus enhancing the chilling of the beverage flowing through the cooling coil 204. Comparatively, the non-linear flow path 266 of the cooling coil 204 is typically longer than the non-linear flow path 266 of the cold plate 206, and thus the cooling coil 204 is more effective at chilling the beverage flowing through the cooling element 250. However, the cold plate 206 takes up less space within the cooler 100, freeing some area of the interior volume 130 of the cooler 100 for other use, such as storing other beverages or cocktail ice. Cooling coils 204 that may be adapted to benefit from the invention are also available from MICRO MATIC USA, Inc., of Brooksville, Fla., among other sources.

Continuing to refer to FIGS. 2 and 3, the MP fitting 202 is configured to fit through the drain hole 110 such that a first end 270 of the MP fitting 202 is exposed and accessible from the interior volume 130 of the cooler 100, while a second end 272 of the MP fitting 202 is exposed and accessible from the exterior of the cooler 100. The MP fitting 202 may be fabricated from a material suitable for contact with beverages intended for use with the cold tap adapter 200. Suitable materials for the MP fitting 202 include aluminum, stainless steel, beverage grade plastics and the like.

The MP fitting 202 may have a threaded exterior 276 that allows one or more nuts 278 to secure the MP fitting 202 within the drain hole 110. A gasket or other seal 220 may be disposed between the nut 278 and exterior of the sidewall 106 of the cooler 100 to prevent leakage through the drain hole 110. In one embodiment, nuts 278 and gaskets 220 are utilized on both sides of the drain hole 110. In another alternative as shown in FIG. 3, the threaded exterior 276 of the MP fitting 202 may be configured to engage a threaded inside diameter of the drain hole 110 for use with coolers 100 having threaded drain holes.

As discussed above and shown in FIG. 2, the first end 270 of the MP fitting 202 is coupled to the cooling element 250, either directly or via a short length of connecting tubing 264. The second end 272 of the MP fitting 202 is coupled by tubing 210 to a valve 208, such as a faucet, and by tubing 216 to a keg 212 or other beverage source. In one embodiment, the tubing 216 may be coupled to the keg 212 via a pump 214. In other embodiments, the tubing 216 may be coupled to the keg 212 via a regulator assembly (not shown) for providing gas to the keg 212 for pressurized delivery of the beverage through the cold tap adapter 200.

Figure 4:
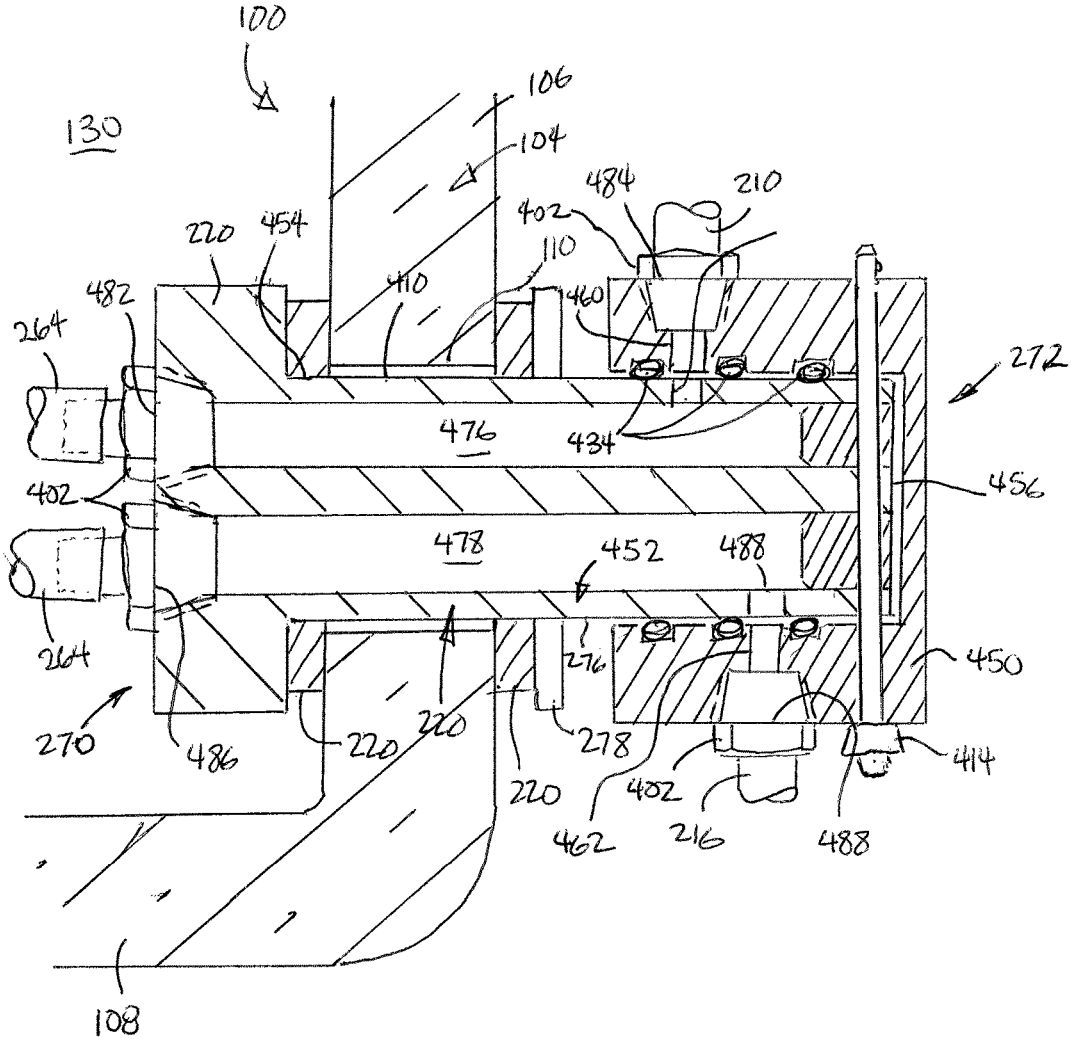
FIG. 4 is a partial enlarged sectional view of the cold tap adapter.

FIG. 4 is partial enlarged sectional view of one embodiment of the MP fitting 202 of the cold tap adapter 200. In the embodiment depicted in FIG. 4, the first end 270 of the MP fitting 202 includes a head 222 that is larger than the diameter of the drain hole 110, so that a single nut 278 and gasket 220 need be utilized on one side of the drain hole 110 to secure the MP fitting 202 within the drain hole 110. Although the head 222 is shown disposed in the interior volume 130 of the cooler 100 in FIG. 4, the head 222 (and optionally the gasket 220 as well) may be alternatively disposed on the exterior of the cooler 100 with the nut 278 engaging the threaded exterior 276 of the MP fitting 202 within the interior volume 130 of the cooler 100.

The MP fitting 202 includes at least two passages 476, 478 formed between the first and second ends 270, 272. The first passage 476 fluidly terminates at a first port 482 formed at the first end 270 of the MP fitting 202 and fluidly terminates at a second port 484 formed at the second end 272 of the MP fitting 202. Similarly, the second passage 478 fluidly terminates at a first port 486 formed at the first end 270 of the MP fitting 202 and terminates a second port 488 formed at the second end 272 of the MP fitting 202. In some embodiments, the ports 482, 484, 486, 488 are configured to connect to tubing 264, 210, 216 that connects the MP fitting to the cooling element 250, keg 212 and valve 208. In other embodiments, the ports 482, 486 are configured to directly connect to the cooling element 250 without the use of tubing 264. In one example, the ports 482, 484, 486, 488 may be configured as nipples for direct connection with tubing 264, 210, 216. In another example, the ports 482, 484, 486, 488 may be threaded to mate with fittings 402 that facilitate connection with tubing 264, 210, 216.

In the embodiment depicted in FIG. 4, MP fitting 202 may include a tubular body 452 and a cap 450. The tubular body 452 includes a shaft 410 that is sized to pass at least partially through the drain hole 110. The passages 476, 478 formed between the first and second ends 270, 270 of the MP fitting 202 are formed through the body 452. An interior end 454 of the tubular body 452 terminates at the head 222 and defines the first end 270 of the MP fitting 202. Thus, the ports 482, 486 that terminate one side (i.e., the side within the cooler 100) of the passages 476, 478 are proximate the interior end 454, either as part of the body 452 or part of the head 222. The head 222 disposed at the interior end 454 of the shaft 410 of the tubular body 452 is larger in diameter than the shaft 410. Thus, the head 222 allows additional space for forming the ports 482, 486.

An exterior end 456 of the tubular body 452 defines the second end 272 of the MP fitting 202. As discussed above, the shaft 410 may define the threaded exterior 276 of the MP fitting 202 that engages the nut 278 for securing the MP fitting 202 in the drain hole 110. The ports 484, 488 may be formed in the exterior end 456 of the tubular body 452 or in the cap 450.

The cap 450 is coupled to the exterior end 456 of the tubular body 452. The cap 450 includes the ports 484, 488 that fluidly terminate the opposite side (i.e., the side outside the cooler 100) of the passages 476, 478. The cap 450 includes passages 460, 462 that couple the passages 476, 478 to the ports 484, 488 via passages 430, 432 formed in the exterior end 456 of the tubular body 452. The cap 450 is larger in diameter than the shaft 410 to provide additional space for forming the ports 484, 488. The interface between the cap 450 and the shaft 410 may include a plurality of o-rings 434 or other seals for preventing leakage and maintaining isolation between the passages 476, 478. In one embodiment, a pin 414, such as a fast pin, clevis pin or other removable fastener, may be disposed through holes formed in the cap 450 and the shaft 410 to retain the cap 450 and the shaft 410. The pin 414 may be easily removed from the cap 450 and the shaft 410 to facilitate removal of the MP fitting 202 from drain hole 110 of the cooler 100.

Figure 5:
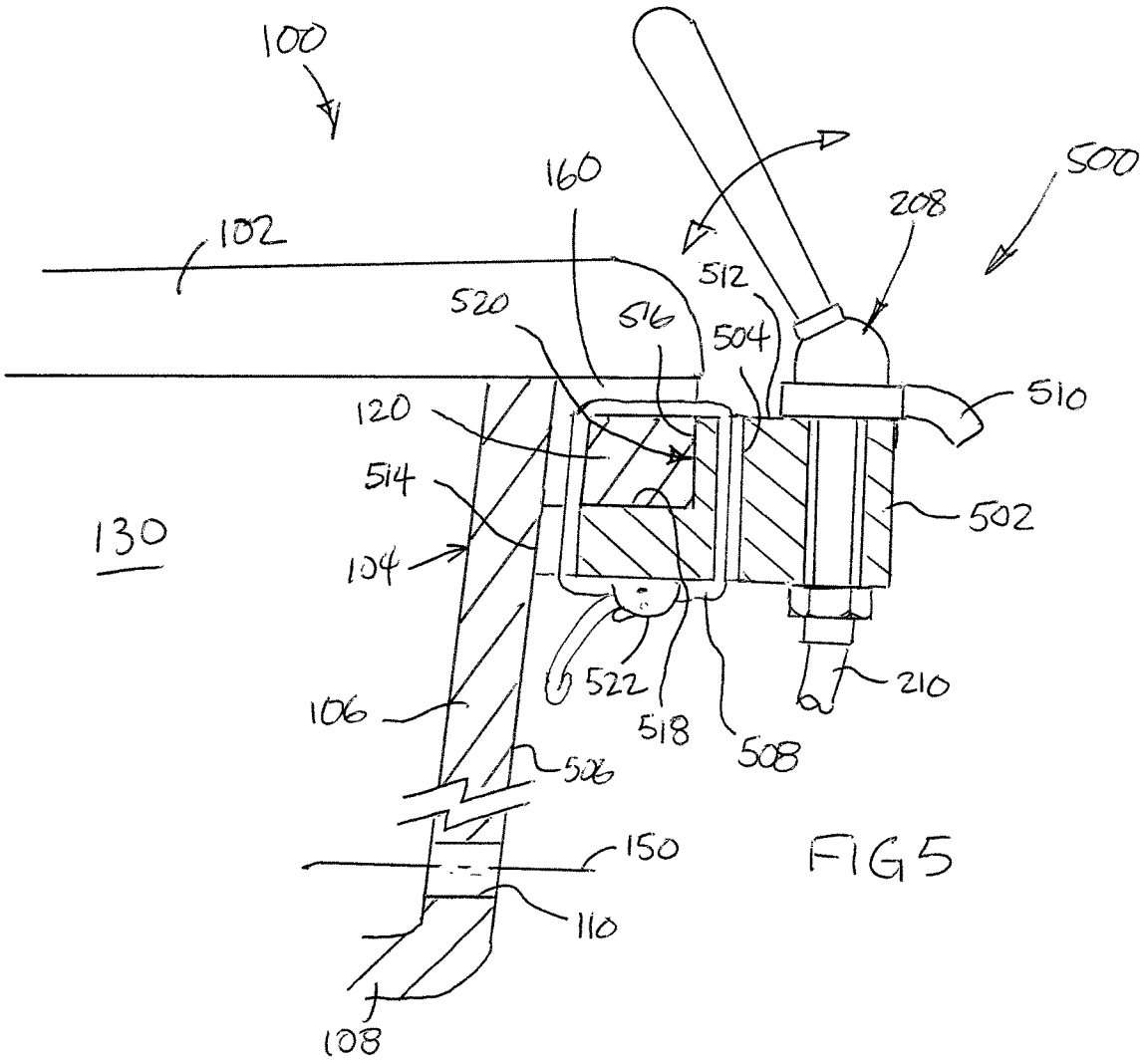
FIG. 5 is an side sectional view of a tap holder configured to engage with a sidewall of a conventional cooler to hold a valve in a first orientation.

FIG. 5 is an exploded view of a tap holder 500 configured to engage with the sidewall of a conventional cooler 100. The MF fitting 202 of the cold tap adapter 200 is not shown in FIG. 5. As described above, a valve 208 is utilized for dispensing beverages from the cold tap adapter 200. In some embodiments, the valve 208 may simply be coupled to a free end of the tubing 210. In the embodiment depicted in FIG. 5, the valve 208 is configured as a tap which is non-destructively coupled to the cooler 100 by the tap holder 500. That is, the tap may be removably coupled to the cooler 100 by the tap holder 500 without altering the physical construction of the cooler. In other words, the tap holder 500 may be removed from the cooler after use, returning the cooler to its original form as purchased from the manufacturer without any "after purchase" physical modifications to the cooler that are purpose specific for holding a tap to the cooler 100.

In one embodiment, the tap holder 500 is a block 502. The valve 208 is coupled to the block 502. For example, the valve 208 may be disposed through a hole or slot formed in the block 502.

In the embodiment depicted in FIG. 5, the block 502 has a first side 514 configured to conform to a contour of an exterior surface 506 of the sidewall 106 of the base 104 and/or has a notch 520 formed in a top 512 of the block 502 configured to conform to a contour of an outer wall 516 and bottom 518 of the flange 160 of the base 104. The block 502 is interfaced with a strap 508. For example, the strap 508 may pass through a slot 504 formed in the block 502. Alternatively, sections of the strap 508 may be secured the block 502, for example, by a screw, bolt or rivet, or by other fastening techniques.

The strap 508 is sized to pass through the aperture 160 formed through the flange 120. Upon tightening and securing the strap 508 utilizing a buckle 522, the block 502 is snuggly abutted against the mating conforming portion of the exterior surface 506 of sidewall 106 of the base 104.

In one example, the valve 208 is secured to the block 502 such that a spout 510 of the valve 208 is oriented 90 degrees relative to a centerline of the drain hole 110 formed through the base 104. For example, the block 502 may hold the valve 208 so that the spout 510 of the valve 208 is oriented substantially parallel to the exterior surface 506 of sidewall 106 to which the block 502 is abutted. Said differently, the block 502 may hold the valve 208 so that the spout 510 of the valve 208 is oriented substantially perpendicular to the front of the cooler 100, the front of the cooler 100 of the cooler 100 being the side of the cooler opposite the lid hinge.

In another example, the valve 208 is secured to the block 502 such that the spout 510 of the valve 208 is oriented in the same direction as the centerline of the drain hole 110 formed through the base 104. For example, the block 502 may hold the valve 208 so that the spout 510 of the valve 208 is oriented substantially perpendicular to the exterior surface 506 of sidewall 106 to which the block 502 is abutted. Said differently, the block 502 may hold the valve 208 so that the spout 510 of the valve 208 is oriented substantially perpendicular to the front of the cooler 100, the front of the cooler 100 being the side of the cooler opposite the lid hinge.

Figure 6:
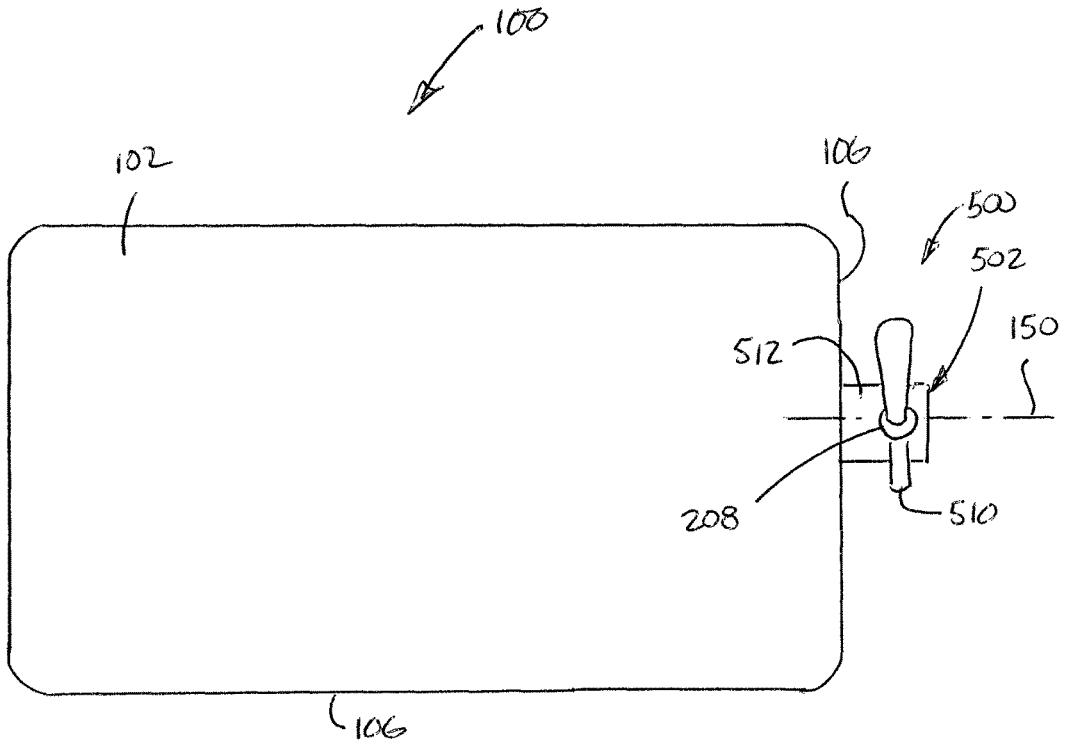
FIG. 6 is a top view of a conventional cooler illustrating a valve in a second orientation.

Optionally, the valve 208 may be secured to the block 502 in a manner that the orientation of the valve 208 is repositionable. For example, the valve 208 may have a feature such as a tab that can be selectively engaged with a plurality of mating features, such as slots formed in the block 502. By selecting into which slot the tab is inserted, the orientation of the valve 208 relative to the centerline of the drain hole 110 may be selected. For example, the valve 208 may be repositioned relative to the block 502 between orientations that are parallel and perpendicular to the drain hole 110. The ability to select the orientation of the valve 208 relative to the cooler 100 is advantageous because in some applications, it may be desirable to have the short side of the cooler 100 facing the persons seeking to dispense beverages while in other applications, it may be desirable to have the long side of the cooler 100 facing the persons seeking to dispense beverages, as shown in FIG. 6.

Figure 7:
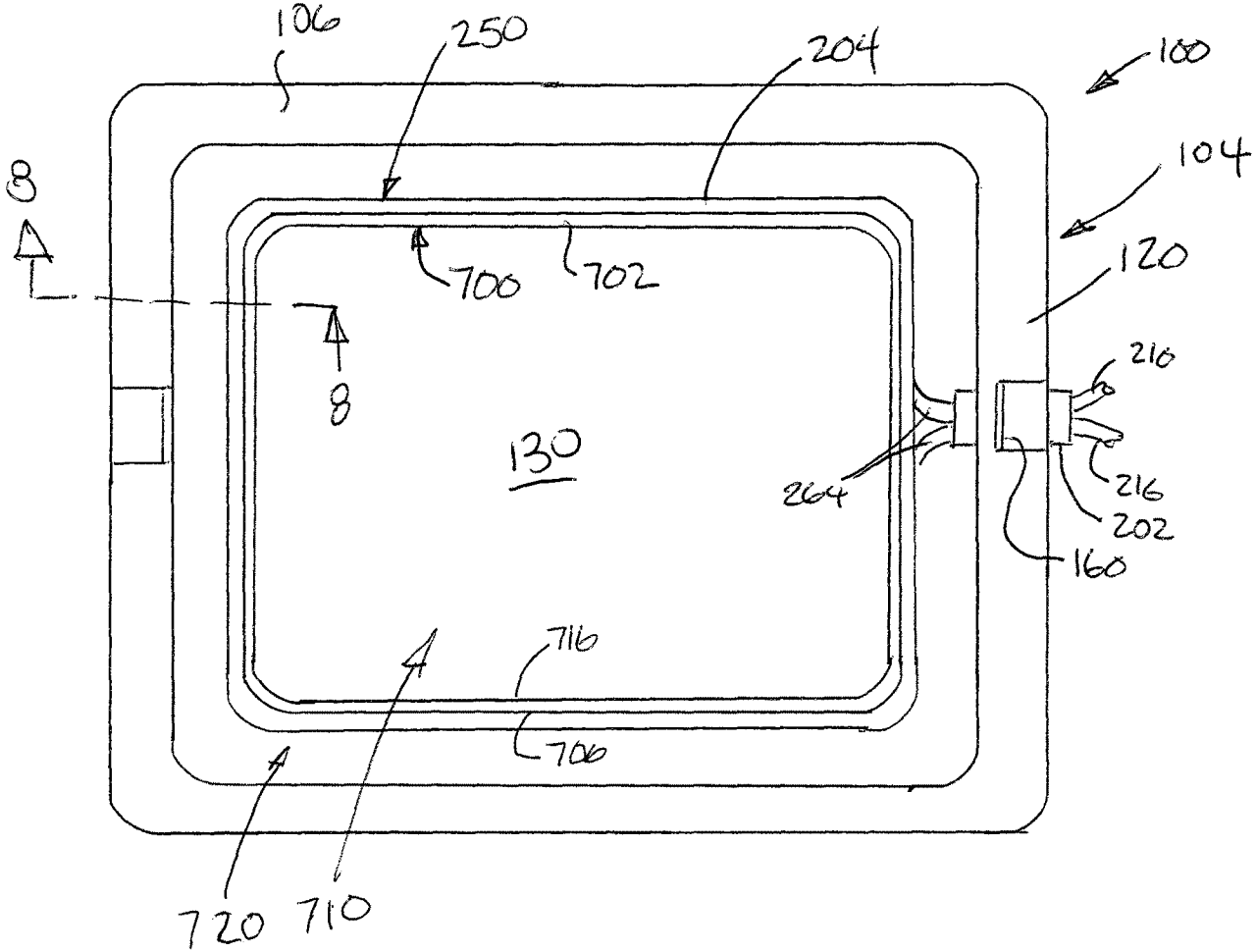
FIGS. 7 and 8 are top and partial sectional views of an interior of a conventional cooler equipped with a cold tap adapter.
Figure 8:
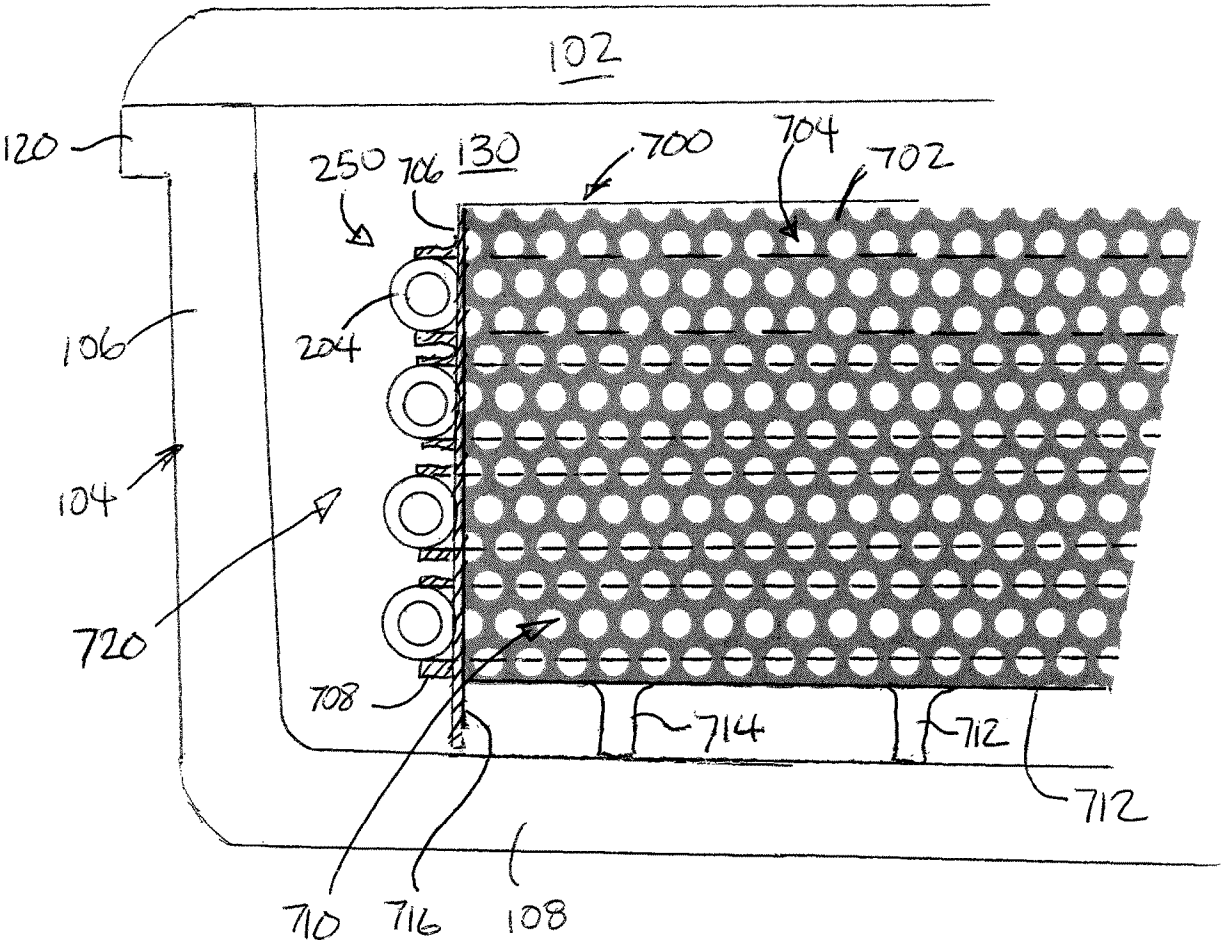

FIGS. 7 and 8 are top and partial sectional views of an interior of a conventional cooler 100 equipped with a cold tap adapter 200. The cold tap adapter 200 illustrated in FIGS. 7 and 8 has a cooling element 250 in the form of coils 204. The coils 204 are secured in a predefined position to an exterior surface of a coil holder 700. The coil holder 700 is configured to separate the interior 130 of the cooler 100 into an interior region 710 that is free of coils 204 and an exterior region 720 in which the coils 204 reside. The exterior region 720 may be filled with ice to cool the coils 204 and beverage circulating within the coils 204. The interior region 710 may also be filled with ice but since the interior region 710 is free of coils 204, the interior region 710 may be utilized to hold beverages, food or other items that can be freely and easily retrieved from the cooler 100 without damaging the coils 204.

In one embodiment, the coil holder 700 is a metal or plastic plate 702 that generally conforms to the shape of the sidewalls 106. For example, the plate 702 of the coil holder 700 may be a rectangular or cylindrical tube. The plate 702 generally includes a plurality of apertures 704 formed therethrough. The apertures 704 may be holes, for example punched holes, or alternatively, the apertures 704 may be openings in an expanded or perforated sheet of metal or plastic plate 702. Alternatively, the plate 702 may be sold.

An exterior side 706 of the plate 702 includes a plurality of tube holders 708. An interior side 716 of the plate 702 faces the interior region 710 of the cooler 100 while the exterior side 706 of the plate 702 faces the exterior region 720 of the cooler 100. The tube holders 708 are sized to retain the coils 204 in position wrapped around the exterior side 706 of the plate 702. In one example, the tube holders 708 may be outwardly bent tabs extending from the plate 702.

A bottom 712 of the plate 702 may include a plurality of legs 714. The legs 714 allow water from ice melting in the interior and exterior regions 710, 712 of the cooler 100 disposed on either side 706, 710 of the plate 702 to freely flow to the drain hole 110.

Thus, an adapter kit has been described above which may be utilized to non-destructively convert a conventional ice cooler into a cold tap, also known as a jockey box, without altering the physical construction of the cooler. Advantageously, once the adapter kit is removed from the cooler, the cooler does not include any penetrations other than those that would have been present in the cooler as originally purchased from the cooler manufacturer. This enables the cooler to can be used both as a jockey box, and additionally return to its original form for use as a conventional ice chest.

Although various embodiments which incorporate the teachings of the present invention have been shown and described in detail herein, those skilled in the art can readily devise many other varied embodiments that still incorporate these teachings.

What is claimed is:

1. An adapter kit for non-destructively adapting a cooler having a melt water drain hole into a cold tap, comprising:

a metal cooling element adapted for cooling liquid within the cooler, the cooling element having a cooling element inlet port and a cooling element outlet port; and a multi-passage (MP) fitting comprising:

a body having a first end adapted to be exposed to an interior volume of the cooler and a second end adapted to be exposed to an outside of the cooler, the body sized to removably extend at least partially into the melt water drain hole formed through the cooler;

a first passage formed through the body between a first outlet port disposed on the first end and a first inlet port disposed on the second end; and a second passage formed through the body between a second outlet port disposed on the first end and a second inlet port disposed on the second end, the first outlet port is couplable to the cooling element inlet port and the second outlet port is couplable to the cooling element outlet port.

2. The adapter kit of claim 1, wherein the cooling element is a cold plate.

3. The adapter kit of claim 1, wherein the cooling element is a tubular coil.

4. The adapter kit of claim 1, wherein the body of the MP fitting further comprises:

a treaded exterior.

5. The adapter kit of claim 1, wherein the body of the MP fitting further comprises:

an outer flange extending radially form the body, the outer flange adapted to prevent the body from passing through the melt water drain hole.

6. The adapter kit of claim 5 further comprising:

a seal having an inside diameter greater than a diameter of the body and less than a diameter of the outer flange.

7. The adapter kit of claim 1 further comprising:

an adapter having a hole configured to sealingly receive the second end, the adapter configured to fluidly couple the cooling element inlet port and the cooling element outlet port to the first and second passages of the MP fitting.

8. A cooler comprising:

a base having a bottom and sidewalls, the sidewalls of the base having a melt water drain hole formed therethrough;

a metal cooling element disposed in an interior volume of the base, the cooling element having an non-linear flow path formed therein, the non-linear flow path terminating at a cooling element inlet port and a cooling element outlet port; and a multi-passage (MP) fitting comprising:

a body having a first end exposed to the interior volume of the base and a second end exposed an exterior of the base, the body removably disposed at least partially into the melt water drain hole formed through the body;

a first passage formed through the body between a first outlet port disposed on the first end and a first inlet port disposed on the second end, the first outlet port fluidly coupled to the cooling element inlet port; and a second passage formed through the body between a second outlet port disposed on the first end and a second inlet port disposed on the second end, the second outlet port fluidly coupled to the cooling element outlet port.

9. The cooler of claim 8, wherein the cooling element is a cold plate.

10. The cooler of claim 8, wherein the cooling element is a tubular coil.

11. The cooler of claim 8, wherein the body of the MP fitting further comprises:

a treaded exterior.

12. The cooler of claim 8, wherein the body of the MP fitting further comprises:

an outer flange extending radially form the body, the outer flange adapted to prevent the body from passing through the melt water drain hole.

13. The cooler of claim 12 further comprising:

a seal having an inside diameter greater than a diameter of the body and less than a diameter of the outer flange.

14. The cooler of claim 8 further comprising:

an adapter having a hole configured to sealingly receive the second end, the adapter configured to fluidly couple the cooling element inlet port and the cooling element outlet port to the first and second passages of the MP fitting.

15. The cooler of claim 8 further comprising:

a beverage tap secured to a handle mount or a tie-down mount of the base.

16. The cooler of claim 10 further comprising:

a metal plate configured to conform to a shape of the sidewalls of the cooler, the coils wrapped around an exterior side of the metal plate such that the coils are disposed between the metal plate and the sidewalls.

17. The cooler of claim 16, wherein the metal plate further comprises:

a plurality of apertures formed through the metal plate.

18. The cooler of claim 17, wherein the metal plate comprise a plurality of legs configured to allow melt water to flow below the metal plate.

19. The cooler of claim 16, wherein the metal plate is spaced above the bottom of the cooler.

* * * * *